United States Patent [19]

Ogita

[11] 4,148,848

[45] Apr. 10, 1979

[54] AIR BLEED TYPE CARBURETOR

[75] Inventor: Tamotu Ogita, Susono, Japan

[73] Assignee: Toyota Jidosha Kogyo Kabushiki Kaisha, Toyota, Japan

[21] Appl. No.: 852,239

[22] Filed: Nov. 17, 1977

[30] Foreign Application Priority Data

Oct. 21, 1977 [JP] Japan ..... 52-125851

[51] Int. Cl.[2] ..... F02M 23/06

[52] U.S. Cl. ..... 261/39 A; 261/121 B; 123/119 D; 123/124 R

[58] Field of Search ..... 261/121 B, 39 A; 123/124 R, 119 D

[56] References Cited

U.S. PATENT DOCUMENTS

| | | | |
|---|---|---|---|
| 3,548,792 | 12/1970 | Palmer | 261/121 B |
| 3,810,606 | 5/1974 | Masaki | 261/39 A |
| 3,831,910 | 8/1974 | Shadbolt | 261/39 A |
| 3,857,908 | 12/1974 | Brown et al. | 261/121 B |
| 3,906,910 | 9/1975 | Szlaga, Jr. | 261/121 B |
| 3,987,131 | 10/1976 | Hisatomi et al. | 261/121 B |

FOREIGN PATENT DOCUMENTS

| | | | |
|---|---|---|---|
| 2431678 | 1/1975 | Fed. Rep. of Germany | 261/121 B |
| 2559079 | 9/1976 | Fed. Rep. of Germany | 261/121 B |

*Primary Examiner*—Tim R. Miles
*Assistant Examiner*—Gregory N. Clements
*Attorney, Agent, or Firm*—Stevens, Davis, Miller & Mosher

[57] ABSTRACT

Disclosed is an air bleed type carburetor for supplying an air fuel mixture to an engine, which carburetor comprises a high altitude control system and a low altitude control system, each system being provided with a control valve device for controlling a bleed air flow to a main jet of the carburetor, and an altitude compensating device for selectively switching the high altitude control system and the low altitude control system in accordance with changes in altitude. The carburetor can supply a desirable air fuel ratio in accordance with changes in altitude and with changes in the operating characteristics of the engine.

9 Claims, 1 Drawing Figure

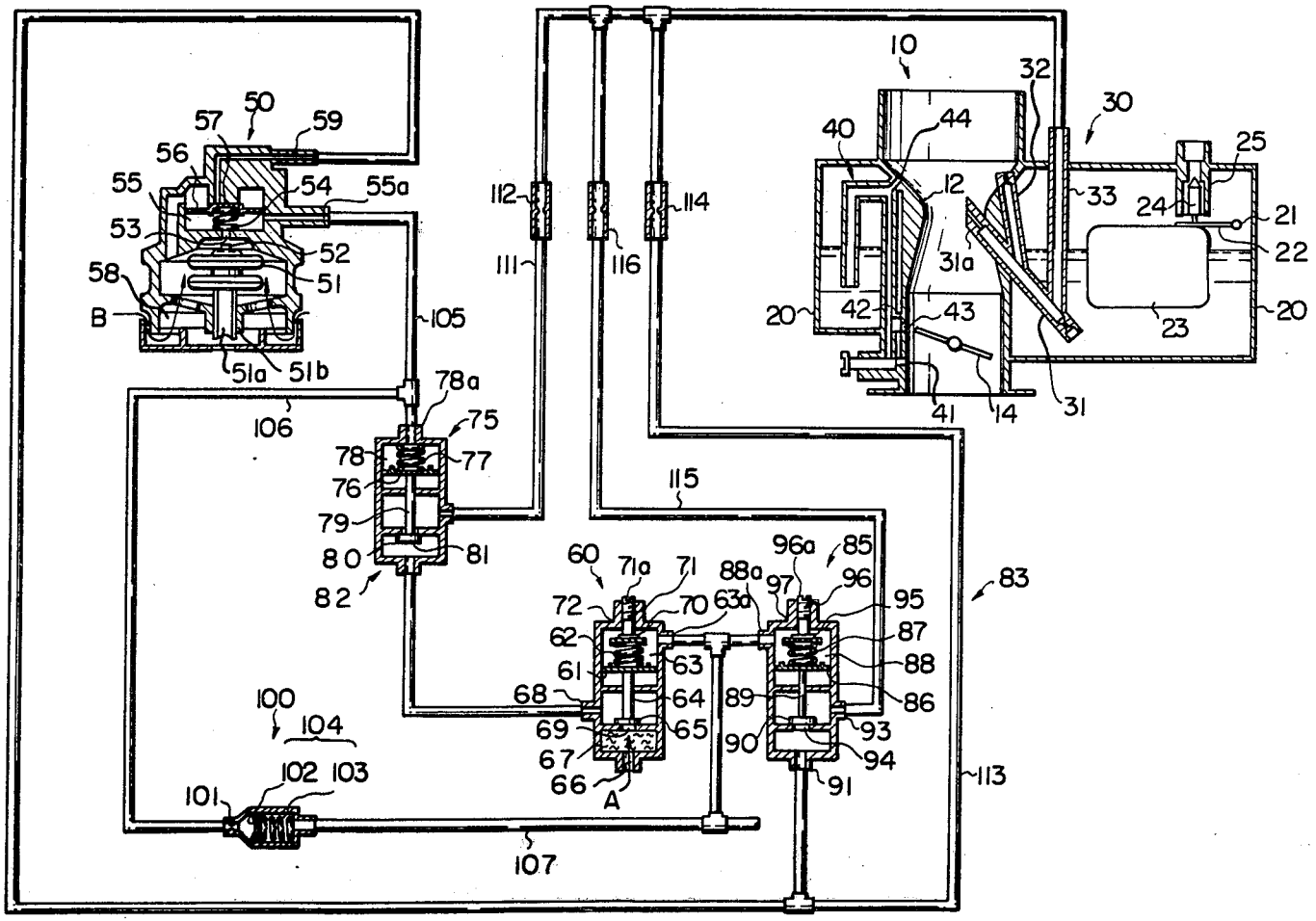
10
12
14
20
21
22
23
24
25
30
31
31a
32
33
40
41
42
43
44
50
51
51a
51b
52
53
54
55
55a
56
57
58
59
60
61
62
63
63a
64
65
66
67
68
69
70
71
71a
72
75
76
77
78
78a
79
80
81
82
83
85
86
87
88
88a
89
90
91
93
94
95
96
96a
97
100
101
102
103
104
105
106
107
111
112
113
114
115
116
A
B

AIR BLEED TYPE CARBURETOR

BACKGROUND OF THE INVENTION

This invention relates to an air bleed type carburetor for supplying an air-fuel mixture to an engine mounted on a vehicle, especially to an air bleed type carburetor which can vary the operating characteristics of a carburetor for obtaining a desirable enriched air fuel ratio in accordance with changes in altitude and with changes in the operating characteristics of the engine.

In conventional carburetors, the air fuel ratio is enriched for obtaining increased engine power when the throttle valve of the carburetor is opened. On the other hand, since the conventional carburetors, especially fixed venturi carburetors, mix a certain volume of air with a certain volume of fuel, when a vehicle which has the conventional carburetor mounted thereon is at high altitude, due to the decrease of the atmospheric pressure (and the specific weight of air), the total amount of intake air in weight is decreased and air fuel ratio is enriched. As a result, harmful contaminants, such as carbon monoxide (CO) and hydro carbon (HC) contained in exhaust gas emitted from the engine are increased and an engine power drop is caused. In addition, since the throttle valve is frequently opened due to the engine power drop at high altitude, the harmful CO and HC contaminants contained in the exhaust gas emitted from the engine can be further increased.

In the copending application Ser. No. 845,601 filed on Oct. 26, 1977, the applicant of the present invention has provided an altitude compensating system of a carburetor for obtaining a desirable enriched air fuel ratio, so as to obviate the above-mentioned problems. The system comprises: a device for enriching the air fuel ratio after the engine load has reached a predetermined first value; an altitude compensating valve device for supplying compensating air in accordance with changes in altitude; a control valve device communicated with the altitude compensating valve device for permitting the compensating air to pass after the engine load has reached a predetermined second value, and; a switching valve device disposed at a position between the control valve device and a main jet of a carburetor and interlocked with a throttle valve of the carburetor for switching the compensating air.

BRIEF SUMMARY OF THE INVENTION

The present invention is to improve the carburetor disclosed in the copending application.

An object of the present invention is to provide an air bleed type carburetor which comprises a high altitude control system and a low altitude control system, each system being provided with a control valve device for controlling a bleed air flow to a main jet of the carburetor, and an altitude compensating device for selectively switching the high altitude control system and the low altitude control system in accordance with changes in altitude.

Another object of the present invention is to provide an air bleed type carburetor which can easily be constructed with commercially available parts.

A further object of the present invention is to provide an air bleed type carburetor in which the operating characteristics of the carburetor at which the air fuel ratio is enriched can be easily adjusted to a predetermined value and in which the altitude level at which the control systems are switched can be adjusted to a predetermined value.

Other features and advantages of the invention will be apparent from the detailed description of the invention set forth below with reference to the accompanying drawing.

BRIEF DESCRIPTION OF THE DRAWING

The FIGURE is a schematic sectional view of an air bleed type carburetor according to the present invention.

DETAILED DESCRIPTION OF THE INVENTION

An air bleed type carburetor according to the present invention will now be explained with reference to the accompanying drawing. Referring to the FIGURE, a carburetor 10 is provided with a venturi throat 12, a throttle valve 14, a main metering system 30 and an idle system 40, each of which systems supplies fuel from a float chamber 20 to the inside of the carburetor 10. The float chamber 20 is provided with a float 23 which is connected to an arm 22 pivoted by a pin 21. Due to the vertical displacement of the float 23, a needle-valve 24 fixed to the arm 22 cooperates with a valve seat 25 and controls the fuel supply from a fuel tank (not shown) communicated with the valve seat 25 so that the fuel level in the float chamber 20 is maintained constant.

The main metering system 30 is provided with a main jet 31, which jet communicates the float chamber 20 with the venturi throat 12 and which jet has a main nozzle **31*a* fixed in the front portion thereof. A main air jet 32 communicates the main jet 31 with a position upstream of the venturi throat 12 and mixes air supplied from the main air jet 32 with fuel in the main jet 31 so that the compensation of the air fuel ratio and the atomization of fuel are increased. The main jet 31 is further provided with a compensating air jet 33. As will be described later, the compensating air jet 33 is communicated with both a power control system at a high altitude 83 and a power control system at a low altitude 82. The two systems 82 and 83 are controlled by an altitude compensating device 50 in accordance with changes in altitude so that the carburetor 10** can create a desirable air fuel ratio at any altitude.

The idle system 40 is provided with an idle jet 42 which communicates the float chamber 20 with an idle port 41 located downstream of the throttle valve 14. One or more by-pass holes 43, located at a position facing to the edge of the throttle valve 14 in the closed position, and a pilot air jet 44, located at a position upstream of the venturi throat 12, are communicated with the idle jet 42. The idle system 40 supplies fuel to the inside of the carburetor 10, when the engine speed is low (in other words, when the throttle valve 14 is almost closed.).

An altitude compensating device 50 comprises: an aneroid bellows 51 which is filled with a gaseous medium having a predetermined pressure (for example, air having a pressure of 1 kg/cm$^2$) and is vertically displaced in accordance with changes in altitude; a diaphragm chamber 55, partitioned by a diaphragm 56, which chamber 55 has a valve seat (having a relief port formed thereon) 53 cooperated with a valve 52 connected to the top end of the aneroid bellows 51 and which chamber 55 has a spring 54 mounted therein for urging the diaphragm 56, and; another valve seat 57 which cooperates with the diaphragm 56 for controlling air (arrow B) introduced through a filter 58. The valve seat 57 is communicated with an air port 59. A vacuum port 55*a* of the diaphragm chamber 55 is communicated with an intake mainfold of the engine (not shown), through vacuum pipes 105, 106 and 107, and a valve 100, for preventing the reverse flow of the vacuum from occurring. The valve 100 is provided with a throttling element 101 and a device 104 comprising a stopper valve 102 and a spring 103. Accordingly, when the predetermined altitude has been reached, the aneroid bellows 51 displaces the valve 52 upward and the valve seat 53 is closed. Then, after the diaphragm chamber 55 is filled with vacuum introduced through the vacuum port 55*a*, the diaphragm 56 is displaced downwardly against the spring 54. As a result, air (arrow B) is supplied to the air port 59 through the filter 58 and the valve seat 57. (The altitude compensating device 50 shown in the FIGURE, has the aneroid bellows 51 secured to the body with a screw bolt 51*b* connected to the bottom of the aneroid bellows 51. When the screw bolt 51*b* is turned with a tool (not shown), which is engaged with a notch 51*a* formed at the end of the screw bolt 51*b*, the altitude level at which compensating air is supplied is adjusted to a predetermined value.)

The above-mentioned altitude compensating device 50 can supply a predetermined air flow when the predetermined altitude has been reached. However, instead of the above-mentioned altitude compensating device, an altitude compensating device (not shown) which can supply various air flows in accordance with changes in altitude can be utilized in the present invention.

The power control system at a low altitude 82 comprises: a first control valve device 60, which supplies a compensating air to the main jet 31 of the carburetor 30 in accordance with changes in the operating characteristics of the engine, and; a second control valve device 75, which is actuated by a vacuum supplied from the intake manifold (not shown) through the vacuum pipes 105, 106 and 107 and which switches the compensating air supplied from the first control valve device 60 in accordance with changes in altitude.

The control valve device 60 comprises: a diaphragm chamber 63, partitioned by a diaphragm 61, which has a spring 62 for urging the diaphragm 61; a valve 65 connected to the diaphragm 61 via a valve rod 64, and; a valve seat 69 which cooperates with the valve 65 for controlling air (arrow A) to an outlet port 68 introduced from the inlet port 66 through a filter 67. A vacuum port 63*a* of the diaphragm chamber 63 is communicated with the vacuum pipe 107 which is communicated with the intake mainfold of the engine (not shown). As a result, when the force acting on the diaphragm 61 due to the intake vacuum of the engine (not shown) is larger than the urging force generated by the spring 62, in other words in the high vacuum range (or low load range of the engine), the valve 65 is opened. At that time, air (arrow A) supplied from an inlet port 66 is supplied to the second control valve device 75 through an outlet port 68.

The first control valve device 60 shown in the FIGURE is provided with a screw bolt 71 for urging a rear seat 70 of the spring 62. When the screw bolt 71 is turned with a tool (not shown), which is engaged with a notch 71*a* formed at the end of the screw bolt 71, the urging force of the spring 62 can be adjusted and the switching level at which the valve 65, for controlling the compensating air, is opened can be adjusted to a predetermined value. The screw bolt 71 is provided with an O-ring (not shown) for sealing.

The urging force of the spring 62 can also be adjusted when the spring is exchanged with another spring having a different spring coefficient.

The second control valve device 75 comprises: a diaphragm chamber 78, partitioned by a diaphragm 76, which has a spring 77 for urging the diaphragm 76; a valve 80 connected to the diaphragm 76 via a valve rod 79, and; a valve seat 81 which cooperates with the valve 80 for controlling air supplied from the first control valve device 60. A vacuum port 78*a* of the diaphragm chamber 78 is communicated with the vacuum pipe 105, which is communicated with the vacuum port 55*a* of the altitude compensating device 50. As mentioned above, the diaphragm chamber 55 of the altitude compensating device 50 is filled with the intake vacuum supplied from the intake pipe of the engine (not shown) when the predetermined altitude is reached. As a result, the diaphragm chamber 78 of the second control valve device 75 is also filled with the intake vacuum at high altitude and, then, the valve 80 is closed and the supply of compensating air through the power control system at a low altitude 82 is stopped. On the other hand, at low altitude, the valve 80 of the second control valve device 75 is opened and the compensating air supplied from the first control valve device 60 is supplied to the compensating air jet 33 of the carburetor 10 through an air pipe 111 and a throttling element 112 for controlling air flow. The urging force of the spring 77 installed in the second control valve device 75 is adjusted to be low enough so that, at a higher altitude than a predetermined level, the valve 80 is always closed due to the intake vacuum.

The high altitude control system 83 comprises a bias air passage which comprises an air pipe 113 and a throttling element 114 for controlling air flow and which supplies compensating air supplied from the altitude compensating device 50 to the compensating air jet 33 of the carburetor 10 at high altitude, so that the decreased specific weight of air at high altitude can be compensated, and; a third control valve device 85 for controlling compensating air supplied from the altitude compensating device 51. The third control valve device 85 has a construction similar to that of the first control valve device 60 and comprises: a diaphragm chamber 88, partitioned by a diaphragm 86, which has a spring 87 for urging the diaphragm 86; a valve 90 connected to the diaphragm 86 via a valve rod 89, and; a valve seat 94 which cooperates with the valve 90 for controlling air supplied from the altitude compensating device 50 through an inlet port 91 to an outlet port 93. A vacuum port 88*a* of the diaphragm chamber 88 is communicated with the intake pipe of the engine (not shown) through the vacuum pipe 107 as the vacuum port 63*a* of the first control valve device 60 is communicated with the intake pipe. As a result, when the force acting on the diaphragm 86 due to the intake vacuum of the engine (not shown) is larger than the urging force generated by the spring 87, in other words, in the high vacuum range (or low load range of the engine), the valve 90 is opened. At high altitude, air supplied from the altitude compensating device 50 through the inlet port 91 is supplied to the compensating air jet 33 of the carburetor 10 through the outlet port 93, an air pipe 115 and a throttling element 116 for controlling air flow.

The third control valve device 85 shown in the FIGURE is provided with a screw bolt 96 for urging a rear seat 95 of the spring 87. When the screw bolt 96 is turned with a tool (not shown), which is engaged with a notch 96*a* formed at the end of the screw bolt 96, the urging force of the spring 87 can be adjusted and the switching level at which the valve 65, for controlling the compensating air, is opened can be adjusted to a predetermined value. The screw bolt 96 is provided with an O-ring (not shown) for sealing. The urging force of the spring 87 can also be adjusted when the spring is changed to another spring having a different spring coefficient.

The operation of the air bleed carburetor according to the present invention will now be explained.

(1) Operation when a vehicle, on which the air bleed carburetor of the present invention is mounted, is at low altitude.

The aneroid bellows 51 and the valve 52 of the altitude compensating device 50 are displaced downward, the vacuum port 55*a* is filled with atmospheric air through the valve seat 53 and no air is supplied from the air port 59. The valve 100 prevents the atmospheric air flow through the vacuum port 55*a* to the intake pipe of the engine (not shown) from occurring. As a result, the diaphragm chamber 78 of the second control valve device 75 in the low altitude control system 82 is filled with atmospheric air and the valve 80 is opened. On the other hand, the compensating air flow to the high altitude system 83 is stopped.

When the force due to the intake vacuum of the engine is larger than the urging force generated by the spring 62 of the first control valve device 60 (in the low load range of the engine), the valve 65 is opened and the compensating air is supplied to the compensating air jet 33 of the carburetor 10.

When the force due to the intake vacuum of the engine is smaller than the urging force generated by the spring 62 of the first control valve device 60 (in the high load range of the engine), the valve 65 is closed and the supplying of compensating air is stopped, and then the air fuel ratio is enriched.

(2) Operation when a vehicle, on which the air bleed carburetor of the present invention is mounted, is at high altitude.

The aneroid bellows 51 and the valve 52 of the altitude compensating device 50 are displaced upward and the vacuum port 55*a* is filled with the intake vacuum of the engine. Then, the diaphragm 56 and the valve 57 are displaced downward, and the compensating air is supplied to the high altitude control system 83 through the air port 59. On the other hand, the valve 80 of the second control valve device 75 is closed due to the vacuum supplied from the vacuum port 55 *a*. Then, the supplying of compensating air through the low altitude control system 82 is stopped.

As mentioned above, the high altitude control system 83 comprises the bias passage 113 and 114 and the third control valve device 85. The bias passage always supplies compensating air to the compensating air jet 33 of the carburetor 10 at high altitude so that the decreased specific weight of air is compensated. On the other hand, the third control valve device 85 is provided with the valve 90 which is opened when the force due to the intake vacuum is larger than the force generated by the spring 87 (in the low load range of the engine), and the device 85 supplies the compensating air to the compensating air jet 33 of the carburetor 10 in the low load range of the engine.

When the force due to the intake vacuum is smaller than the force generated by the spring 87 (in the high load range of the engine), the valve 90 is closed and the supply of compensating air is stopped. Then, the air fuel ratio is enriched.

What we claim is:

1. An air bleed type carburetor for supplying an air-fuel mixture to an engine, which comprises:

an altitude compensating means, communicated with a vacuum supply means and provided with a vacuum port and an air port, said vacuum port being filled with a vacuum supplied from said vacuum supply means and said air port supplying air when the altitude is higher than a predetermined altitude level;

a first control valve means for permitting a bleed air flow to pass to a main jet of said carburetor when the operating characteristic of said engine is lower than a predetermined first load level;

a second control valve means, communicating said first control valve means to said main jet of said carburetor, which is communicated with said vacuum port of said altitude compensating means for permitting said bleed air flow from said first control valve means to pass at low altitude and for preventing said bleed air flow from occurring at high altitude, and;

a third control valve means, communicated with said air port of said altitude compensating means, which permits said bleed air flow to pass at high altitude when the operating characteristics of said engine are lower than those at a predetermined second load level.

2. An air bleed type carburetor according to claim 1, which further comprises a passage which communicates said air port of said altitude compensating means with said main jet of said carburetor via a throttling element for supplying a bleed air to said main jet at high altitude.

3. An air bleed type carburetor according to claim 2, wherein said first control valve means is provided with a diaphragm chamber partitioned by a diaphragm and with a valve actuated by said diaphragm, said diaphragm chamber being communicated with an intake passage of said engine for introducing an intake vacuum which actuates said diaphragm.

4. An air bleed type carburetor according to claim 3, wherein said diaphragm chamber of said first control valve means contains a spring for urging said diaphragm, the urging force of said spring being adjustable.

5. An air bleed type carburetor according to claim 3, wherein said second control valve means is provided with a diaphragm chamber partitioned by a diaphragm and with a valve actuated by said diaphragm, said diaphragm chamber being communicated with an intake passage of said engine for introducing an intake vacuum which actuates said diaphragm.

6. An air bleed type carburetor according to claim 5, wherein said diaphragm chamber of said first control valve means contains a spring for urging said diaphragm, the urging force of said spring being adjustable.

7. An air bleed type carburetor according to claim 2, wherein said altitude compensating means comprises a diaphragm chamber, partitioned by a diaphragm, which is communicated with an intake passage of said engine through said vacuum port and a check valve for controlling an air flow through said air port by way of the intake vacuum supplied from said intake passage, a relief port formed on a wall of said diaphragm chamber, a valve which cooperates with said relief port for switching a vacuum flow through said relief port, and an aneroid bellows, filled with a medium having a predetermined pressure, which displaces said valve in accordance with changes in altitude.

8. An air bleed type carburetor according to claim 7, wherein the altitude level of said aneroid bellows at which said relief valve is open is adjustable.

9. An air bleed type carburetor according to claim 2, wherein each of said first and second control valve means is provided with a diaphragm chamber, partitioned by a diaphragm, and with a valve actuated by said diaphragm, said diaphragm chamber being communicated with an intake passage of said engine and containing a spring for urging said diaphragm against the force due to the intake vacuum, and wherein said altitude compensating means comprises a diaphragm chamber, partitioned by a diaphragm, which is communicated with said intake passage of said engine through said vacuum port and a check valve, a relief port formed on a wall of said diaphragm chamber, a valve which cooperates with said relief valve for switching a vacuum flow through said relief port, and an aneroid bellows, filled with a medium having a predetermined pressure, which displaces said valve in accordance with changes in altitude.

* * * * *